US005384926A

United States Patent [19]

Al-Bargi

[11] Patent Number: 5,384,926

[45] Date of Patent: Jan. 31, 1995

[54] EXPANDABLE LITTER APPARATUS

[76] Inventor: Hamed H. Al-Bargi, 7901 Henry Ave. Bldg. E., Apt. 105, Philadelphia, Pa. 19128

[21] Appl. No.: 138,732

[22] Filed: Oct. 20, 1993

[51] Int. Cl.[6] ..... A61G 1/013

[52] U.S. Cl. ..... 5/627; 5/628

[58] Field of Search ..... 5/627, 625, 626, 628, 5/629

[56] References Cited

U.S. PATENT DOCUMENTS

| | | | |
|---|---|---|---|
| 2,242,311 | 5/1941 | Lucey | 5/627 |
| 2,745,114 | 5/1956 | Cote | 5/627 |
| 3,426,367 | 2/1969 | Bradford | 5/627 |
| 3,886,606 | 6/1975 | Bradford | 5/627 |

*Primary Examiner*—Alexander Grosz
*Attorney, Agent, or Firm*—E. Michael Combs

[57] ABSTRACT

A litter apparatus including an expandable framework is arranged to have secured thereon a cover. The framework includes spaced parallel first tubular bodies, each having a second tubular body, with each second tubular body having a retractable third tubular body that in turn includes a fourth tubular body, wherein the tubular bodies are expandable relative to one another, with first and second forward expandable tubes mounted orthogonally between the first tubular bodies and first and second expandable rear tubes mounted orthogonally between the fourth tubular bodies, whereupon the actuation of plungers within the first tubular bodies permits release of the tubular bodies relative to one another in an expanded orientation relative to one another.

5 Claims, 4 Drawing Sheets

FIG. 3
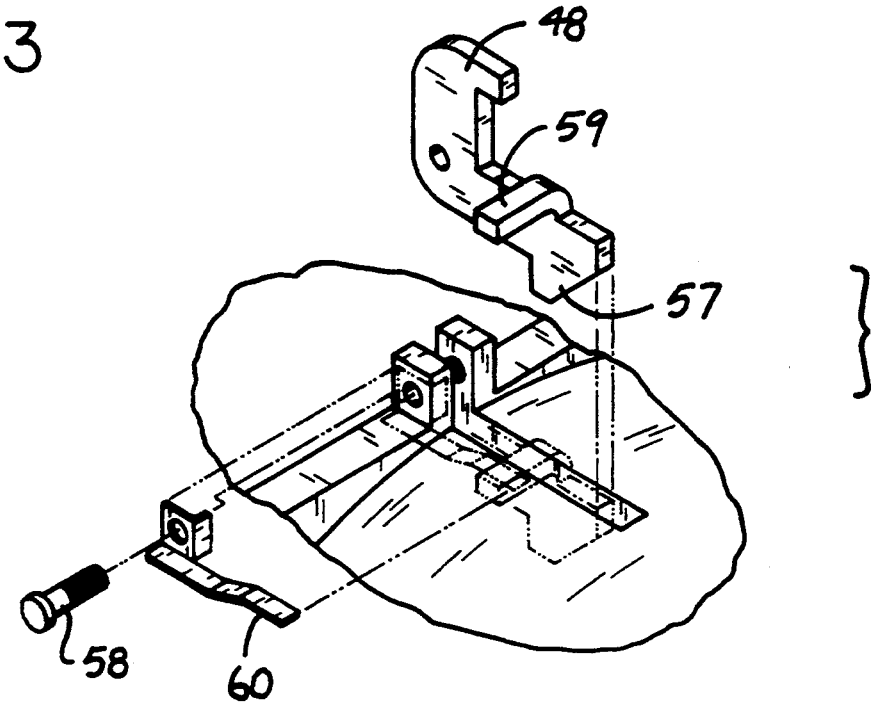
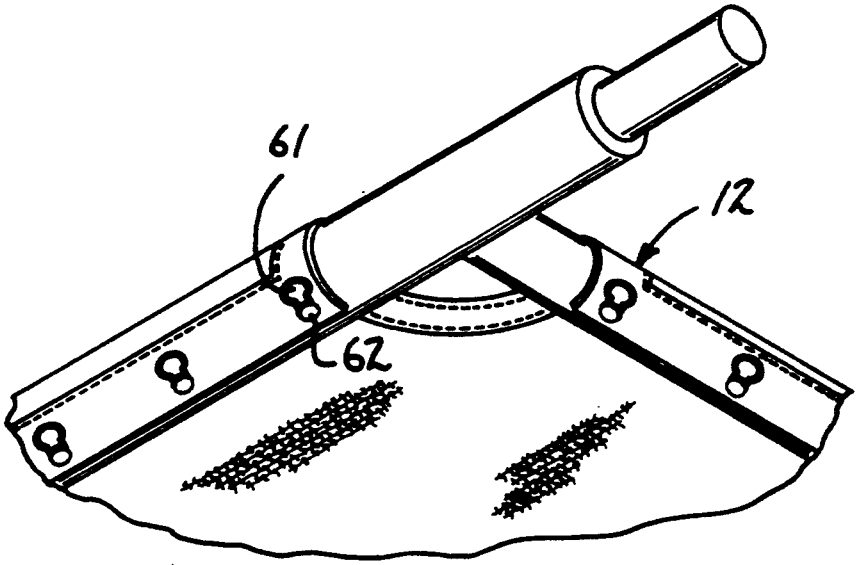
FIG 4

FIG. 5
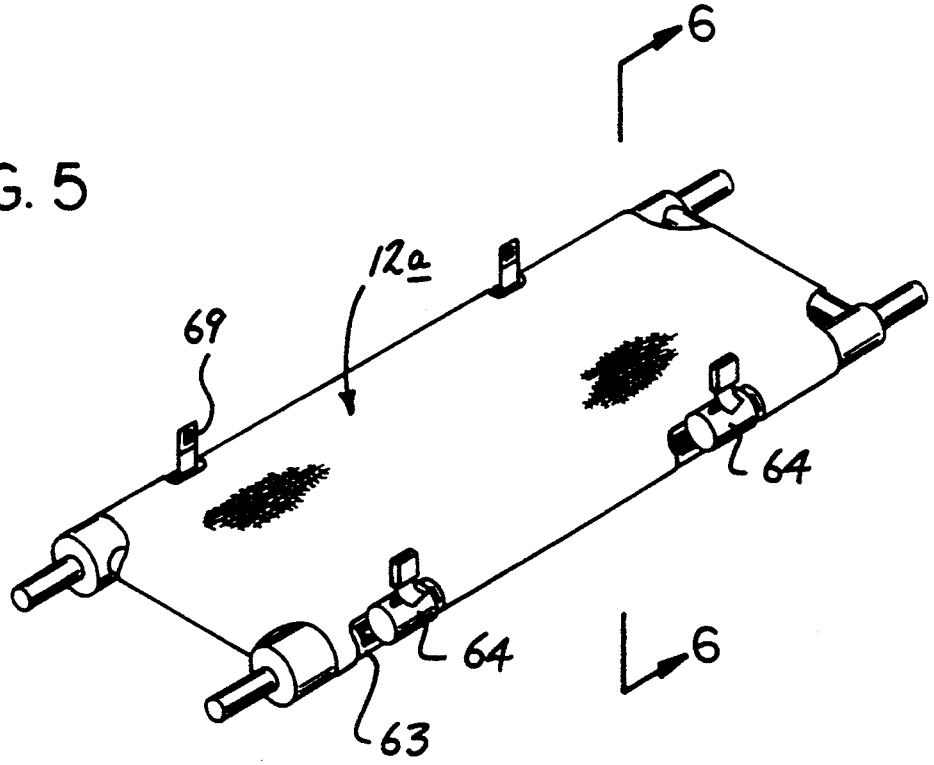
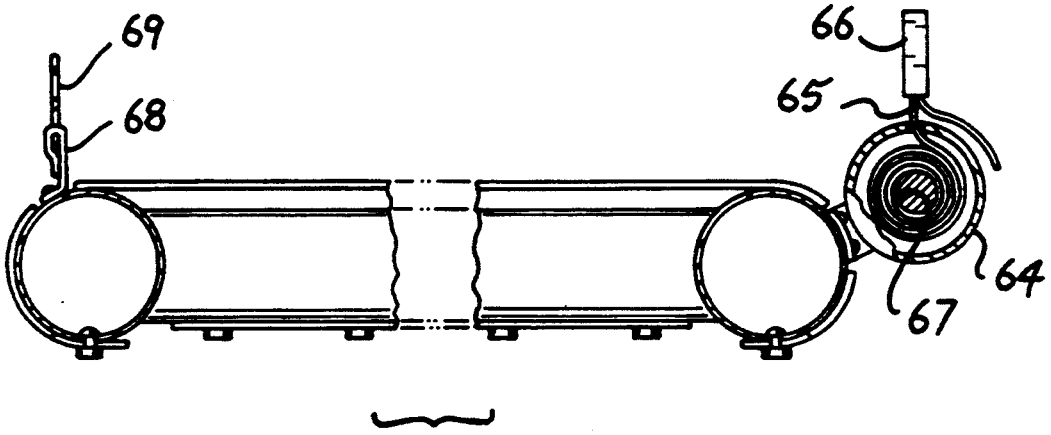
FIG. 6

EXPANDABLE LITTER APPARATUS

BACKGROUND OF THE INVENTION

1. Field of the Invention

The field of invention relates to litter and stretcher structure, and more particularly pertains to a new and improved expandable litter apparatus wherein the same is arranged for compact transport and storage during periods of non-use and upon expansion for support of an individual thereon.

2. Description of the Prior Art

Various stretcher apparatus is available in the prior art as well as restraint structure such as indicated in U.S. Pat. Nos. 5,014,374; 4,601,075; and 4,970,739.

The instant invention attempts to overcome deficiencies of the prior art by providing for an organization arranged for ease of transport and storage and for subsequent expansion during periods of use.

SUMMARY OF THE INVENTION

In view of the foregoing disadvantages inherent in the known types of litter apparatus now present in the prior art, the present invention provides an expandable litter apparatus wherein a framework includes interconnected tube members nested relative to one another for expansion upon the actuation of a release mechanism cooperative with the tube members. As such, the general purpose of the present invention, which will be described subsequently in greater detail, is to provide a new and improved expandable litter apparatus which has all the advantages of the prior art litter apparatus and none of the disadvantages.

To attain this, the present invention provides a litter apparatus including an expandable framework arranged to have secured thereon a cover. The framework includes spaced parallel first tubular bodies, each having a second tubular body, with each second tubular body having a retractable third tubular body that in turn includes a fourth tubular body, wherein the tubular bodies are expandable relative to one another, with first and second forward expandable tubes mounted orthogonally between the first tubular bodies and first and fourth tubular bodies, whereupon the actuation of plungers within the first tubular bodies permits release of the tubular bodies relative to one another in an expanded orientation relative to one another.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved expandable litter apparatus which has all the advantages of the prior art litter apparatus and none of the disadvantages.

It is another object of the present invention to provide a new and improved expandable litter apparatus which may be easily and efficiently manufactured and marketed.

It is a further object of the present invention to provide a new and improved expandable litter apparatus which is of a durable and reliable construction.

An even further object of the present invention is to provide a new and improved expandable litter apparatus which is susceptible of a low cost of manufacture with regard to both materials and labor, and which accordingly is then susceptible of low prices of sale to the consuming public, thereby making such expandable litter apparatus economically available to the buying public.

Still yet another object of the present invention is to provide a new and improved expandable litter apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of an individual latch member for use within the framework structure.

FIG. 4 is a partial isometric illustration indicating mounting of the cover relative to the framework when the framework is an expanded orientation.

FIG. 5 is an isometric illustration of the invention employing a modified cover arranged to accommodate expandable and retractable belt members.

FIG. 6 is an orthographic view, taken along the lines 6—6 of FIG. 5 in the direction indicated by the arrows.

DESCRIPTION OF THE PREFERRED EMBODIMENT

Figure 1:
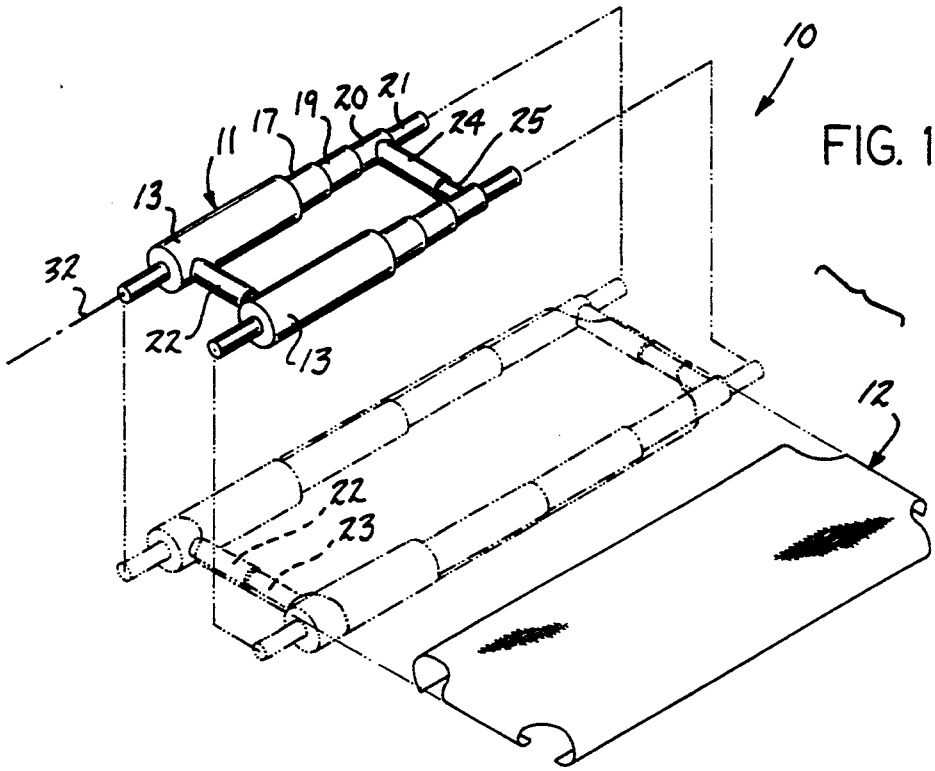
FIG. 1 is an isometric illustration of the invention.

With reference now to the drawings, and in particular to FIGS. 1 to 8 thereof, a new and improved expandable litter apparatus embodying the principles and concepts of the present invention and generally designated by the reference numeral 10 will be described.

More specifically, the expandable litter apparatus 10 of the instant invention essentially comprises an expandable framework arranged to accommodate a cover 12 when the framework is in an expanded configuration, such as indicated in phantom in FIG. 1. To this end, the framework includes spaced parallel first tubular bodies 13 arranged in a coextensive relationship, with each of the first tubular bodies 13 having a first body end wall 14 spaced from a first body front wall 15, with a first handle tube 16 integrally mounted to the first body front wall 15 in a coaxially aligned relationship along an axis 32 of each of the first tubular bodies. It should be noted that the first tubular bodies and the nested tubular members associated therewith are duplicated and to this end, only one such elongate arrangement defined about its own axis 32 will be described, but it should be understood that such is the same for both of the first tubular bodies 13 and the associated tubular bodies nested therewithin. To this end, a second tubular body 17 is received within the first tubular body 13 through the first body end wall 14, with the second tubular body having a second tubular body end wall 18 receiving a third tubular body 19 therethrough, with the third tubular body in turn including a fourth tubular body 20 retractably and expandably received through the third tubular body 19, such that the first, second, third, and fourth tubular bodies are coaxially aligned along the axis 32. A first forward tube 22 is fixedly and integrally mounted to one of the first tubular bodies 13, with the first forward tube 22 telescopingly receiving a second forward tube 23 that in turn is integrally and fixedly mounted to the second of the first tubular bodies 13, such as illustrated in FIG. 1. A first rear tube 24 integrally and fixedly mounted to the fourth tubular body 20 telescopingly receives a second rear tube 25 that in turn is fixedly and integrally mounted to the second of the fourth tubular bodies 20. It should also be noted that each of the fourth tubular bodies includes a second handle tube 21 that is coaxially aligned with one of the first handle tubes, as illustrated.

A first internal web 26 is mounted fixedly within each first tubular body 13 in a spaced relationship relative to an adjacent first body front wall 15, with a second internal web 27 mounted integrally within the second tubular body 17 in facing relationship relative to the first internal web 26, such that a first spring 28 is captured between the first internal web 26 and the second internal web 27. A third internal web fixedly mounted within the third tubular body 19 is arranged in a spaced facing relationship relative to a fourth internal web 31 fixedly mounted within the fourth tubular body 20, with a second spring 30 captured between the third internal web 29 and the second internal web 27 and a third spring 33 captured between the third internal web 29 and the fourth internal web 31. The first, second, third, and fourth internal webs are arranged orthogonally relative to the axis 32, with the first, second, and third springs 28, 30, and 33 coaxially aligned relative to the axis 32. A fifth internal web 35 mounted fixedly within the first forward tube 22 is positioned in adjacency to one of the first tubular bodies 13, with the second forward tube 23 having a sixth internal web 36 in a facing relationship relative to the fifth internal web 35 to capture a fourth spring 74 therebetween. A seventh web 76 mounted within the first rear tube 24 is arranged in a spaced facing relationship relative to an eighth web 77 within the second rear tube 25 to capture a fifth spring 75 therebetween.

Figure 2:
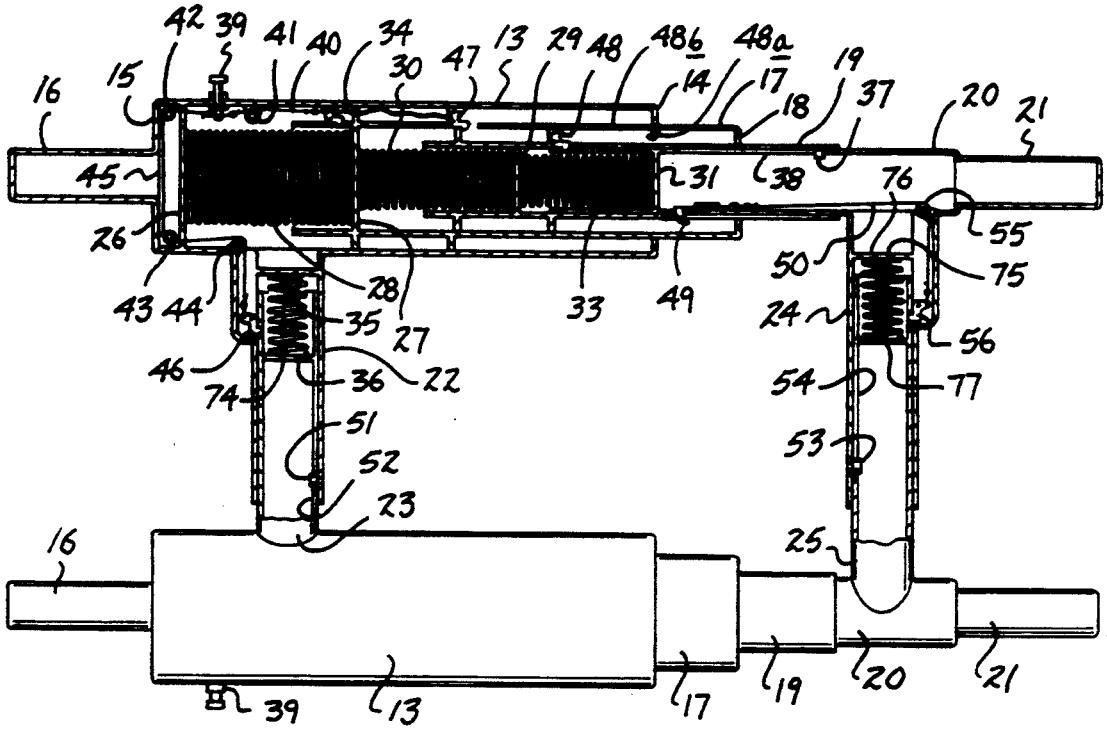
FIG. 2 is an orthographic top view, partially in section, of the framework and its mechanical cooperation.

The third tubular body 19 as indicated is formed with a third tubular body abutment lug 37 slidably mounted within a fourth tubular body slot 38 directed in the fourth tubular body to maintain desired axial displacement of the third and fourth tubular bodies relative to one another. Also as illustrated in FIG. 2, the first forward tube 22 is formed with a forward first tube lug 51 slidably mounted within a forward second tube slot 52, and the first rear tube 24 is formed with a rear first tube lug 53 and a rear second tube slot 54 positioned within the second rear tube 25 to maintain desired displacement of the forward and rear tubes relative to one another when expanded, such as illustrated in FIG. 1 in phantom.

A first latch 34 is pivotally mounted within each first tubular body 13 arranged for engaging a second tubular body opening. A plunger 39 is reciprocatably mounted through each first tubular body, having a first cable 40 extending about a first guide roller 41 to the first latch 34, such that upon projection of the plunger 39 within the first tubular body, the first latch 34 is displaced relative to the second tubular body to permit the first spring 28 to displace the first tubular body relative to the second tubular body. Further, between the first internal web 26 and the first body front wall 15 are spaced second and third guide rollers 42 and 43 directing a second cable 45 that has one end mounted to the plunger 39 and its second end secured to a second latch 46 pivotally mounted within the first forward tube 22, and in turn received within a second forward tube aperture. Third and fourth guide rollers 43 and 44 respectively guide the second cable to the second latch, as illustrated in FIG. 2.

A third latch 47 pivotally mounted within the first tubular body 13 is arranged for engaging a second tubular body opening 17. Fourth latch 48 pivotally mounted within the second tubular body 17 is arranged to engage a third tubular body opening 19. To this end, the first cable 40 extends from the first latch 34 to the third latch 47 to provide for simultaneous disengagement of the first and third latches. Upon release of the second tubular body relative to the first tubular body, a first end wall lug 48*a* mounted to the first tubular body end wall 14 is slid through the first end wall lug receiving slot 48*b* within the second tubular body to engage the fourth latch 48 and displace the fourth latch relative to the third tubular body opening thereby permitting displacement of the second and third tubular bodies relative to one another by action of the third spring 33 and the second spring 30, with the third spring 33 imposing upon the fourth intermediate web 31, such that when the second tubular body is displaced, the second tubular body end wall 18 engages the fifth latch 49 displacing the fifth latch and thereby tensioning a third cable 50 that is guided about a fifth guide roller 55 to a sixth latch 56 that is pivotally mounted to the first rear tube 24 and received within a second rear tube opening thereby releasing the first and second rear tubes relative to one another by action of the fifth spring 75. When the framework 11 is thereby in the expanded orientation, as illustrated in FIG. 1, the cover 12 may be mounted. To this mounting, the cover may employ, as illustrated in FIG. 4, a plurality of keyhole openings 61 arranged to receive engaging heads 62 mounted along the framework 11 at spaced intervals.

The FIG. 3 indicates the use of conventional latch structure, such as the fourth latch 48 that is formed with a latch axle 58 pivotally mounting the fourth latch and an engaging finger 57 to engage an adjacent tubular member, wherein a spring engaging flange 59 is orthogonally directed from the fourth latch to receive an engaging spring 60 to bias the latch in an interlocked relationship.

The FIG. 5 indicates the use of cover openings 63, or a plurality of such openings, including belt retraction housing 64 mounting a securement belt 65, that in turn includes a securement belt latch 66, with a retraction spring 67 secured to the securement belt 65 within the latch housing to bias the belt within the latch housing. A companion belt 68 having a buckle 69 is arranged for engagement to the securement belt latch 66.

Figure 7:
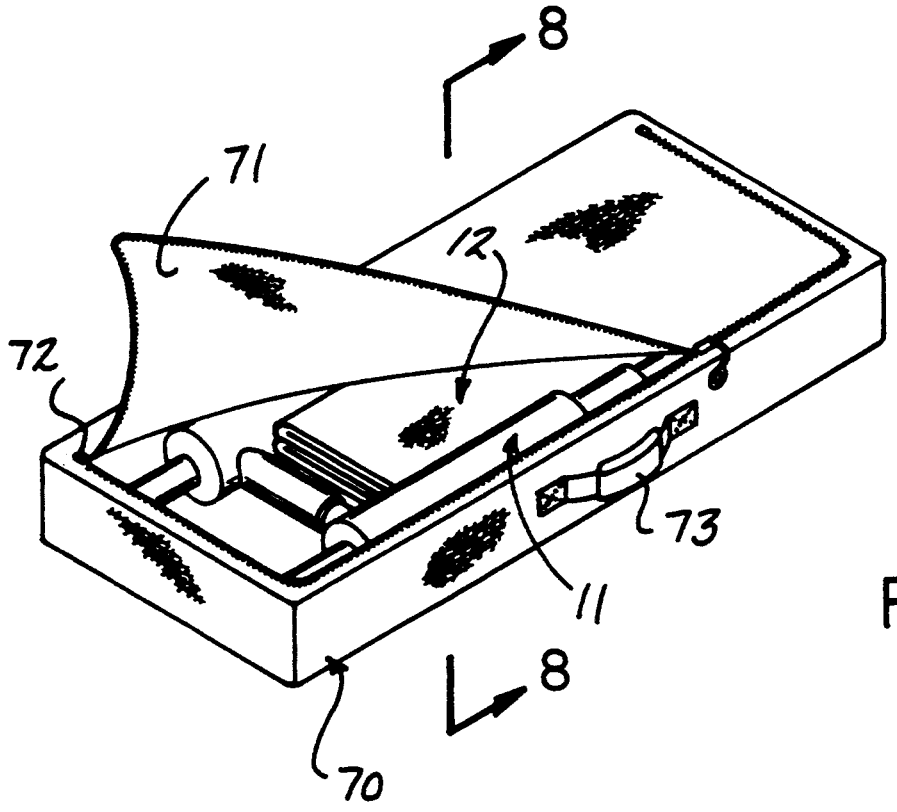
FIG. 7 is an isometric illustration of the invention mounted within a storage case.
Figure 8:
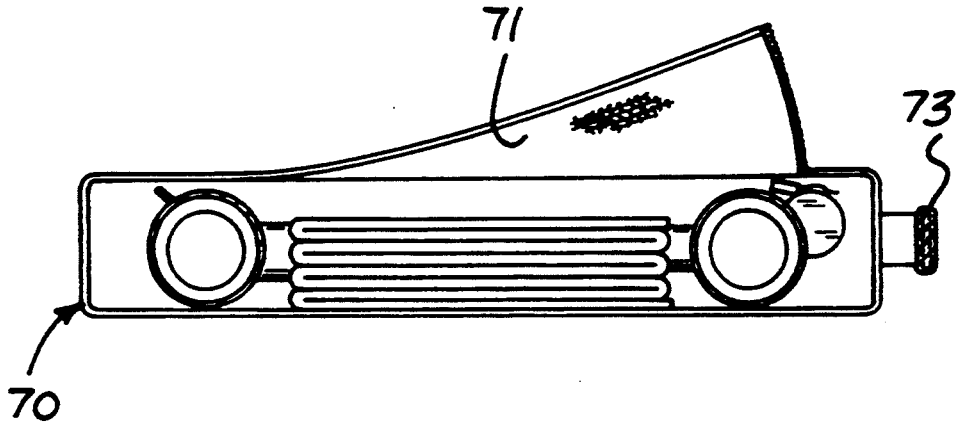
FIG. 8 is an orthographic view, taken along the lines 8—8 of FIG. 7 in the direction indicated by the arrows.

The FIGS. 7 and 8 indicate the use of a container 70, having a container cover 71 secured to the container by a zipper 72 to secure the framework and cover therewithin during periods of storage and transport of the organization, with a handle 73 mounted to the container for ease of transport of the container and organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An expandable litter apparatus, comprising, a framework, the framework arranged in a first retracted position and movable to a second expanded position, with a cover member arranged for securement to the framework when the framework is in the second position, and the framework having spaced first tubular bodies arranged in a parallel coextensive relationship, with each of the first tubular bodies including a second tubular body received therewithin, and each second tubular body having a third tubular body received therewithin, and each third tubular body including a fourth tubular body received therewithin, and each said first tubular body having a first body end wall and a first body front wall, with each said first body front wall having a first handle tube, and each said second tubular body having a second tubular body end wall receiving the third tubular body therethrough, and a second handle tube fixedly mounted to the fourth tubular body coaxially aligned with the first tubular body, and a first forward tube orthogonally and fixedly mounted to one of said first tubular bodies, and a second forward tube telescopingly received within the first forward tube, with the second forward tube integrally and fixedly mounted to a further of said first tubular bodies, with a first rear tube fixedly and integrally mounted to the fourth tubular body, with the first rear tube telescopingly receiving a second rear tube, with the second rear tube fixedly and integrally mounted to a further fourth tubular body, with latch means arranged to simultaneously release the first tubular body relative to the second tubular body, and the third tubular body relative to the second tubular body, and the fourth tubular body relative to the third tubular body, and the second forward tube relative to the first forward tube, and the second rear tube relative to the first rear tube.

2. An apparatus as set forth in claim 1 wherein each said first tubular body has a first internal web arranged in a spaced parallel adjacency to the first tubular body first end wall, and a second internal web fixedly mounted within the second tubular body in facing relationship relative to the first internal web, with a first spring captured between the first internal web and the second internal web, and a third internal web fixedly mounted within the third tubular body in facing relationship relative to the second internal web, and a fourth internal web mounted within the third tubular body in facing relationship relative to the third internal web, with a second spring captured between the second internal web and the third internal web, and a third spring captured between the third internal web and the fourth internal web.

3. An apparatus as set forth in claim 2 wherein the latch means includes a first latch member pivotally mounted within the first tubular body and received within a second tubular body opening, and a plunger reciprocatably mounted through the first tubular body to further include a first cable extending between the plunger and the first latch member, and a first guide roller interposed between the plunger and the first latch member, and a second guide roller and a third guide roller mounted within the first tubular body between the first internal web and the first body front wall, and a fourth guide roller mounted within the first rear body spaced from the third guide roller, and a second latch member pivotally mounted within the first forward tube and received within a second forward tube opening, with the second cable extending from the plunger about the second guide roller, the third guide roller, and the fourth guide roller, with the second cable secured to the second latch member.

4. An apparatus as set forth in claim 3 further including a third latch member pivotally mounted within the first tubular body secured to a further second tubular body opening, with the first cable extending from the first latch member to the third latch member, and a fourth latch member pivotally mounted within the second tubular body received within a third tubular body opening, and the first tubular body end wall having a first end wall lug, and the second tubular body having a first end wall lug receiving slot receiving the first end wall lug slidably therethrough, and the first end wall lug arranged to engage the fourth latch and displace the fourth latch relative to the third tubular body opening.

5. An apparatus as set forth in claim 4 wherein the latch means further includes a fifth latch member slidably mounted within the third tubular body and received within a fourth tubular body opening, whereupon the second tubular body end wall is arranged to engage the fifth latch member and displace the fifth latch member within the third tubular body, with a third cable mounted to the fifth latch member, and a fifth guide roller mounted within the fourth tubular body, and a sixth latch member pivotally mounted within the first rear tube and arranged to engage a second rear tube opening, with the third cable extending from the fifth latch member about the fifth guide roller and secured to the sixth latch member to displace the sixth latch member from the second forward tube opening upon displacement of the fifth latch member within the third tubular body.

* * * * *